US005873782A

United States Patent [19]

Hall

[11] Patent Number: 5,873,782

[45] Date of Patent: Feb. 23, 1999

[54] SPECIFIED RETURN DETERMINATOR

[76] Inventor: Grantley Thomas Aubrey Hall, 8 Seaview Road, Mount Osmond, State of South Australia, Australia

[21] Appl. No.: 696,970

[22] PCT Filed: Feb. 24, 1995

[86] PCT No.: PCT/AU95/00088

§ 371 Date: Aug. 23, 1996

§ 102(e) Date: Aug. 23, 1996

[87] PCT Pub. No.: WO95/22883

PCT Pub. Date: Aug. 31, 1995

[30] Foreign Application Priority Data

Feb. 24, 1994 [AU] Australia ..... PM 4044
Dec. 7, 1994 [AU] Australia ..... PM 9911

[51] Int. Cl.[6] ..... A63F 9/22

[52] U.S. Cl. ..... 463/25; 364/410

[58] Field of Search ..... 465/25, 28, 6, 465/42; 364/412, 410

[56] References Cited

U.S. PATENT DOCUMENTS 4,322,612 3/1982 Lange .
4,494,197 1/1985 Troy et al. .
4,775,937 10/1988 Bell .
4,875,164 10/1989 Monfort .

OTHER PUBLICATIONS

Gormey, *Automated Guaranteed Odds* Bin HTA Fuasibi City Model, Jun. 1995.

*Primary Examiner*—Michael O'Neill

*Attorney, Agent, or Firm*—Dorn, McEachran, Jambor & Keating; Vangelis Economou

[57] ABSTRACT

A method for providing set price and/or variable price betting by operating on a pool of bets and ensuring that the total amount to be paid out on an outcome does not exceed the total amount available. The method includes the steps of: initialising all parameters and variables. The set price(s) is determined for none, one or more of the possible outcomes; and a representation of each set price is produced. For each set price bet on an outcome; the set price is assigned to each set price bet, and a record of the bet is produced including the set price in that record. A variable price(s) is determined for none, one or more of the possible outcomes by operating on the pool of bets for each such outcome by: i) dividing the pool of bets amongst the number of results on which dividends must be paid; ii) diminishing to allow for commission; iii) diminishing to allow for the amounts reserved to be paid out on set price bets on that outcome; iv) dividing amongst the amounts bet at a variable price on that outcome. A representation of each variable price so determined is then produced and at least one record of the bet is then produced. The method provides set and/or variable price betting by; (A) ensuring that the amount reserved to be paid out on any set price bet does not exceed the pool of bets after it has been i) divided amongst the number of results on which dividends must be paid; ii) diminished to allow for commission; iii) diminished to allow for the amounts reserved to be paid out on previous set price bets on that outcome and (B) ensuring that the total amount to be paid out on variable price bets on an outcome does not exceed the pool of bets after it has been i) divided amongst the number of results on which dividends must be paid; ii) diminished to allow for commission; iii) diminished to allow for the amounts reserved to be paid out on set price bets on that outcome.

25 Claims, 4 Drawing Sheets

SPECIFIED RETURN DETERMINATOR

TECHNICAL FIELD

This invention relates to a method and apparatus which provide set price and variable price betting on events on a totailsator system and in particular, a computerised totalisator system.

PRIOR ART

Totalistors have been in operation in many countries for many years. When accepting bets such as win bets, they generally function by collating the amounts bet on each competitor (e.g. horse, dog, football team) in an event such as a race or a match, collating the total amount bet, subtracting a commission (usually at a fixed percentage rate which includes a proportion for tax) and then calculating the price relating to each competitor according to the amount bet on it in accordance with one of the following formulae:

$$O(X) = \frac{(1 - VCR) \times TBV}{BV(X) \times NR} - 1 \text{ or } VD(X) = \frac{(1 - VCR) \times TBV}{BV(X) \times NR}$$

where the variables have the meanings given in the Appendix. The word "price", when used herein, will incorporate both the meaning of "odds" and "dividend".)

Consequently, they are called parimutuel ("mutual bet") totalisator because those who are successful divide the stake less a percentage in commission; there is no outside agency setting the market.

Often the rate of return is increased by deducting "fractions" such that the price given is truncated after the first decimal place e.g. 1.29 becomes 1.2.

The same principles can be (and usually are) extended to prices calculated for place betting and combinations of results such as quinellas (certain competitors running first and second), trifectas (certain competitors running first, second and third in a given order), fourtrellas (certain competitors winning four given events on the day) etc. The prices are calculated in much the same way, but instead of the amount bet on a given competitor to win, the relevant figure is the amount bet on a certain outcome.

But, it is a necessary consequence of the way these current totalisators operate that, not only do the prices on offer vary frequently during betting but, the punter can only be given the price as calculated after al bets have been made. As this price can be quite different from that which may have been shown earlier in betting, this can lead to much frustration on the part of the punter.

However, one of the main advantages of the current variable price system is that, no matter what the outcome of the event, the totalisator operator is virtually guaranteed of the commission at the rate specified. Another advantage is that there is no need to limit the size of any bet in order to guarantee profitability of the system.

Bookmakers on the other hand offer set prices, usually up to a certain limit, in accordance with a market as framed by them or on their behalf and, while the prices fluctuate with supply and demand, the price given to a punter at any stage in betting remains fixed.

One of the main disadvantages of the bookmakers' method of supplying set prices is that usually the rate of return is less than the commission rate would indicate. In fact, the problem can be greater than this; bookmakers can, and do, lose.

The term "commission rate" used herein means the degree to which prices (and therefore the amount available to be distributed) are reduced below the level which would return the whole pool to successful punters. There are a number of methods which can be used to allow for commission and therefore determine the commission rate. While it might be expected that the rate of return to the operator of the betting system would be equal to the commission rate and, the more prices were reduced the greater his return would be, this is not always so. The reason is that the rate of return may be affected by other factors such as the accuracy of the market and the mechanisms of the system. So, the commission rate is a theoretical rate and unless particular mechanisms are used, the rate of return will often be a lesser rate.

The term "set price" has essentially the same meaning as other commonly used terms such as "fixed price", "fixed odds", "guaranteed odds" or "set odds". The preferred term is "set price".

Hereinafter, the term "parameter" includes the meaning of a variable quantity that may be preset and/or varied periodically and the term "variable" includes the meaning of a quantity that stores information relating to the pool of bets and which may vary frequently during the operation of the method.

There have been previous attempts to devise a totalisator which can give set prices. Most of these have been based on the same principle as the bookmaker with the same attendant lesser rate of return and risk of loss.

One method which adopted a different approach in an attempt to overcome the risk of loss was "A Fixed Odds Betting System", Australian Patent serial number 590777 (AU-B-6011286) by ATL Pty. Ltd. (hereinafter referred to as "ATL"). The aim of that invention was to guarantee the liability created by any given fixed price bet by utilising the funds in the variable pool and, as part of that process, to ensure that the total fixed price liability on any one contestant could not exceed the total amount bet It succeeded in this particular aim.

However, it did not claim to deliver, nor did it succeed in delivering a system which could guarantee the full rate of commission. In addition, it had a number of other significant disadvantages.

Merely dealing with the question of fixed price liability is not sufficient in itself to ensure that such a system is viable any more than it would be to simply provide set prices for a bookmaker-type system (which many systems can do). ATL's mechanism has implications for other aspects of the system such as:

a) whether the system involves an element of risk i.e. whether it is a gambling mechanism;

b)the rate of return;

c)the manner in which the prices, for a given outcome, respond to;

1/set price bets on that outcome;

2/variable price bets on that outcome;

3/set price bets on other outcomes;

4/variable price bets on other outcomes;

d) the effect on turnover of a negative response from punters to excessive and unrepresentative depression of the prices generated by the system (due in part to c) above);

and, unless particular attention is paid to these effects, the system will not function in any practical sense. ATL has not revealed any valid mechanism for dealing with these aspects and, for the most part, has not revealed the necessity to do so either.

For example, any "government legislated body" would consider it essential to guarantee that an amount at least equal to the T&C (tax and commission) deducted from their "transferred funds" would result from an implementation of the system. Not only is this not prescribed by the statement of ATL's invention, but application of the only examples given (the equations) and the best method show that if T&C could ever be maintained at a sufficient level, it would be the result of a gambling mechanism—ATL only addressed the problem of a gambling mechanism with respect to fixed price liability. Further, not only could the actual T&C be less than the rate specified but in various circumstances, a loss could be incurred. And, the ATL invention would lead to other problems such as a decrease in turnover due to punter dissatisfaction with excessive and unrepresentative depression of prices and/or excessively fluctuating prices.

Problems can arise if the set and/or variable prices are not representative of the amounts bet on a given outcome (and therefore representative of the demand for that outcome); if they are not then punters will bet inordinately low amounts on the outcomes for which the prices are relatively too low and bet in excess on those for which the prices are relatively too high. If this happens, one group of punters will be relatively disadvantaged compared to another and, punters as a whole will lose faith in the system. There are many examples of this type of effect in the ATL system and this is discussed briefly at b) immediately below.

There are 3 causes of unrepresentative prices:

a) Incorrect allowance for the various commitments (set dividends, variable dividends and commission) on the number of results on which dividends must be paid, compared to the amount bet, with the consequence that the commitments exceed the amounts available to pay them. This problem with respect to the ATL invention is mentioned above and it arises because ATL only addressed itself to fixed price liability; while having successfully ensured that fixed price liability could not exceed the total amount bet, once the other commitments are taken into account, the total amount bet is commonly exceeded and, in some instances, not only to a very large degree but to the point where a loss occurs.

b) Arbitrary allocation of amounts available to be distributed amongst the amounts bet e.g. too much allocated to set price bets compared to variable price bets (or vice versa) because of a price that is, or remains, too high (or because of a limit which is too high) or, individual price(s) that are too high or too low compared to the amounts bet thereon. That is, the allocation of an inordinate portion of the amount available for distribution to any one group of punters to the disadvantage of other punters.

In this category is the bet limit; while the main object of the limit is to ensure that only a certain subset of the amount available for distribution can be allocated to any given bet, it is preferable if that subset is a certain proportion of the said amount and the bet limit is determined from that proportion by allowing for the rate of dividend at which the bet must be paid.

ATL did not do this but instead, had the same bet limit for each outcome regardless of its price which resulted in a far greater effect for larger prices. In ATL's method, this meant a far greater depression of the larger set prices and hence, produced prices which were unrepresentative of the amounts bet thereon.

c) Improper allocation of amounts resulting from, for example, the cancellation of bets, either innocently or because of fraudulent manipulation of the system—to the detriment of other punters, the totalisator operator and the integrity of the system.

The ATL invention exhibits all of these deficiencies.

Unless particular care is taken to adequately address the problem of fraudulent manipulation of prices, the integrity of the system will be threatened. ATL made some attempt to deal with this matter; however, while it restricts punters' rights, it does not solve the problem.

ATL restricted its patent to a system which operated on "uncancellable" expected dividend (variable) bets. It is clear from an analysis of the ATL specification, that what was meant was bets which are uncancellable after another punter has made a bet at the same terminal at which those bets were made.

However, while being more restrictive than might be deemed necessary, this is quite inadequate to prevent abuse of the system.

The reason is that it allows any punter, either individually or in collaboration with confederates, to have a large bet (and for variable price bets there is no bet limit) in such a way as to cause the prices of other outcomes to be significantly increased, to have set price bets on those outcomes at inflated prices and then remove the original bet.

ATL imposed a similar rule for set price bets except that it was more restrictive and only allowed cancellation where it occurred prior to the next bet at that terminal. However, by synchronising bets with confederates and the use of delaying tactics, much the same problems could arise as those previously described.

Unscrupulous punters would rapidly find and take advantage of such weaknesses, with the end result that the prices would become quite unrepresentative of the amounts properly bet on each outcome and the system would rapidly fall into disrepute and/or bankruptcy.

To overcome the problem, a better method is required than merely limiting the cancellation of bets in the manner proposed by ATL.

A closely related problem is the need to ensure that there is no significant punter dissatisfaction with the bet that is received.

Those who bet at set prices, do so because they can obtain a price with which they are satisfied and know that it will not change no matter what subsequent events occur in the market.

One problem with a system that must process multiple transactions in a short space of time is that the price available at the time of a request by a punter may be quite different from that available and observed by him just moments, or even a fraction of a second, before. This is because another bet or bets could have been (and probably would have been) made on the event in question in between the time the punter observed the price on a display and when his request was processed. If these bets were small and/or representative of the general market, the prices may not have changed noticeably but if this was not so, they may have changed significantly. In addition, a mistake could be made in registering a punter's bet For these reasons, unless he is given some means of ensuring that the bet is correct and that the price is acceptable, it would lead to dissatisfaction and tend to defeat the purpose of supplying set prices.

ATL did not address the need to ensure that the price is acceptable. But, because their system allowed cancellation of bets in order to overcome mistakes, a significant number of cancellations would have resulted from punter dissatisfaction with the price received. And, as punters only tend to be dissatisfied with prices that are less than those which they expected, cancellation would tend to happen for prices which shortened. However, the shortening of one price-lengthens other prices and any subsequent cancellation of bets on the former will mean that the prices that have been given on those other outcomes will be too generous.

Repeatedly giving overly generous prices to set price punters will result in a significantly lesser return to variable price punters. Any consequential negative reaction from variable price punters will impact on the size of the variable pool and this in turn will affect the ability to offer set prices. The negative effects on the system could be quite severe.

A related problem is that any significant increase in the rate of cancellation would make the displayed prices noticeably more volatile. This would also have a negative effect on patronage of the system.

In addition, the ATL invention only reveals a system which provides set prices on-course and in particular, by utilising the off-course variable pool. Although ATL asserts that the variable pool could be generated on-course, there is good reason to doubt that a pool of a satisfactory size could be obtained as readily as suggested. Consequently the ATL invention does not show how set prices could be satisfactorily offered to all punters and, in particular, to those betting off-course.

The principal problem is a consequence of something that ATL mentioned itself when it said "Fixed price betting is inherently more attractive to the avid punter . . . ".

The end result of this situation is that unless restrictions (such as only offering set prices on course while obtaining the variable pool off-course) or incentives (such as higher prices) are used, variable price punters will flock to the set price system leaving a significantly reduced variable pool for set price punters to bet against Judging by evidence such as:

1/the behaviour of punters in a number of jurisdictions where the variable pool doubles in size during the last minute (or less) of betting as punters try to judge the prices available;

2/one jurisdiction where set prices are offered off-course (by bookmakers) in opposition to variable prices on the totalisator and it would appear that over 99% of the turnover occurs at set prices;

3/a survey which indicated that about 80% of totailsator punters would prefer to bet at set prices;

the size of the variable pool would be reduced to the point where the operation of the invention would be considerably restricted.

Further, of any amounts that were bet on the variable pool an even larger proportion than at present would most likely be bet at the last minute because the pool would be smaller (due to set prices being available) and consequently, more volatile. The amounts bet at the last minute would be of no use in providing a stable base against which set price punters could bet earlier in betting and this would only compound the problem.

Because of the combination of these two effects, the practical operation of the invention would be restricted, probably quite severely.

These problems can be overcome by various measures which include:

a) offering incentives such as differential prices and/or bonus dividends so that punters are attracted;
   1/to the variable pool;
   2/at an early stage in betting;

b) using a theoretical pool.

However, ATL did not mention these possibilities. Furthermore, especially for favoured (short priced) outcomes, the ATL invention would find great difficulty in maintaining its variable prices in such a way as to provide an incentive because, except in some instances (where other problems are accentuated), the variable prices decrease at a much faster rate than the set prices in response to set price bets.

ATL does not make any mention of the number of results on which dividends must be paid e.g. place dividends (where a dividend must be paid on each "place" result—usually first, second and third); the amounts available for distribution must be divided amongst the number of results on which dividends must be paid.

It is an object of this invention to supply a method for providing set price and/or variable price betting that alleviates or minimises at least one of the above problems or at least provides the public with a reasonable choice.

DISCLOSURE OF THE INVENTION

In accordance with one aspect of the present invention, there is disclosed a method for providing set price and/or variable price betting by operating on a pool of bets and ensuring that the total amount to be paid out on an outcome does not exceed the total amount available, the said method comprising the following steps:

a) initialising all parameters and variables;

b) 1/determining set price(s) for none, one or more of the possible outcomes;
   2/producing a representation of each such set price;
   3/for a set price bet on an outcome;
      i) assigning the set price to the bet;
      ii) producing at least one record of the bet and including the set price in that record(s);

c) 1/determining variable price(s) for none, one or more of the possible outcomes by operating on the pool of bets according to steps for each such outcome which include:
   i) dividing the pool of bets amongst the number of results on which dividends must be paid;
   ii) diminishing to allow for commission;
   iii) diminishing to allow for the amounts reserved to be paid out on set price bets on that outcome;
   iv) dividing amongst the amounts bet at a variable price on that outcome;
   v) producing a representation of each variable price so determined;
   2/for a variable price bet on an outcome, producing at least one record of the bet;

d) providing set and/or variable price betting by;
   1/ensuring that the amount reserved to be paid out on a set price bet does not exceed the pool of bets after it has been;
      i) divided amongst the number of results on which dividends must be paid;
      ii) diminished to allow for commission;
      iii) diminished to allow for the amounts reserved to be paid out on previous set price bets on that outcome;
   2/ensuring that the total amount to be paid out on variable price bets on an outcome does not exceed the pool of bets after it has been;
      i) divided amongst the number of results on which dividends must be paid;
      ii) diminished to allow for commission;
      iii) diminished to allow for the amounts reserved to be paid out on set price bets on that outcome;
   3/repeating at least steps b) and c) with each bet This invention provides set prices on a totalisator system by utilising a pool of bets common to both the set price portion of the totalisator and the variable price portion of the totalisator. It is this feature which enables those prices to be offered with virtually no risk of diminution in the rate of commission and with virtually no risk of loss. If there is to be a reduced return due to any imperfection in the market, this invention has the capacity to ensure that it is borne by parties other than the totalisator operator.

As the set price totalisator of this invention is dependent on at least some form of variable price totalisator (even if it has a theoretical pool), the term set price totalisator used herein means a totalisator system capable of delivering set prices but which nonetheless incorporates a variable price portion. The term variable price totalisator means a totalisator system capable of delivering variable prices whether integrated with a set price totalisator or not.

Various forms of the invention will now be described by way of example only.

In one preferred form, the pool is established by accepting variable price bets.

In another preferred form, the pool is established by accepting variable price bets and the initial set prices are determined by and calculated from the amounts of those bets. In this form, the set price totalisator is a parimutuel totalisator; even though, as betting proceeds, not every punter receives exactly the same price about a given outcome, the system nonetheless distributes to the successful participants, the total amount bet less a certain amount for commission; the prices are determined solely by the amounts of the bets, with there being no outside agency involved. In this form, there is virtually no risk of loss and virtually no risk of diminution in the rate of commission.

In another preferred form, the pool is established by using variable price theoretical bets (either completely or in part) and this enables set prices to be offered despite the fact that there is only a small amount or even no amount at all in the variable pool. This is achieved by means of the totalisator operator supplying an amount (which would preferably be relatively small compared to the size of the final pool) and then allocating portions of this amount to be placed on each outcome so as to give a market reflecting that devised by them or on their behalf. One preferred method of allocating the amounts (based on the values for a completely theoretical pool) is according to the following formula:

$$BV(X) = \frac{(1 - VCR) \times TBV}{VD(X) \times NR}$$

where the variables have the same meaning as before but the commission rate may vary and may not be at the same level as for the usual variable price system. (Such theoretical bets may be used by the totalisator operator not only on the variable price totalisator but also on the set price totalisator in relation to various forms of this invention; where theoretical bets need to be distinguished from normal bets, they will be referred to as having been "placed".) These amounts need not be actually placed; the calculations could simply be done as if the amounts had been placed.

In this form of the invention, the chance of a loss could be arranged to be small but it could not always be ruled out completely. And, due to imperfections in the market, it would seem very likely that the rate of return would be less than the commission rate would indicate.

However any such reduction in the rate of return would be small because the amount at risk would only be a small fraction of the size of the final pool and at worst, only a fraction of this would be lost Such a reduction could be further diminished, eliminated or even turned into extra profit in most circumstances by a number of means such as reducing the bet limit, reducing the amount supplied by the totalisator operator as the variable pool increases and/or increasing the commission rate when any amount placed by the totalisator operator is in the pool (and in one form of the invention, reducing that rate linearly as the pool supplied by them is reduced).

One preferred method of supplying a stand-alone set price system (with no actual variable pool at any stage but a completely theoretical pool instead) is to set the market by allocating amounts on each outcome as previously described and increasing the commission rate sufficiently to compensate for any inadequacies in that market. In combination with adjustments to the size of the theoretical pool and the size of the limit, the commission rate could be set at a sufficient level to virtually guarantee a particular rate of return.

In one preferred form, "restricted bets" are used. These bets are restricted in such a way that they effectively prevent fraudulent or other manipulation of prices; examples include:

a) bets which can only be cancelled at the discretion of the tote operator; examples of conditions under which the tote operator might allow cancellation include:
   1/he is satisfied that there is no attempt at price manipulation.
   2/the bet is small
   3/the current price is similar to or less than that when the bet was made.
   4/the bet is such that any negative effect of cancelling it would be covered by a contingency fund.
b) bets which cannot be abused by punters because they are theoretical bets placed by the tote operator.
c) bets which can never be cancelled or otherwise changed once accepted by the tote operator.
d) bets where the punter has specified the minimum price he will take, the bet has been accepted and thereafter cannot be cancelled.
e) bets from an account which has conditions imposed that provide protection from abuse; such as where full personal details and/or a security deposit are required.
f) bets which are "confirmed". This is the preferred option.

In one form, the process of operating on the pool of bets would involve analysing the pool of bets as individual amounts relating to each bet. However, in a preferred form, the process of operating on the pool of bets would include adding some or all individual amounts into one or more running totals so as to enable faster processing. The latter approach has been used in the preferred embodiment.

In one preferred form, the process of operating on the pool of bets would involve analysing all of the amounts bet. However, in another form of the invention, the process of operating on the pool of bets would involve analysing a subset of the amounts bet e.g. a fraction of each individual bet or a fraction of the variable pool prior to the opening of set price betting.

There are numerous methods by which set prices can be determined; they could even be determined manually although this is not a preferred option.

In one preferred form, the step of determining set price(s) for none, one or more of the possible outcomes is accomplished by operating on the pool of bets according to steps for each such outcome which include:

a) dividing the pool of bets amongst the number of results on which dividends must be paid;
b) diminishing to allow for commission;
c) diminishing to allow for amounts reserved to be paid out on set price bets on that outcome;
d) dividing amongst amounts bet on that outcome.

In the calculation, allowance for successful set price bets may be made at step c) and/or step d). In one preferred form, there would be no overlap of that allowance.

A current set price bet may be allowed for in determining the set price to be offered for the current set price bet and in determining variable prices or alternatively, it may only be allowed for in determining variable prices.

The following examples provide some more detail about the ways in which set prices may be calculated:

In one preferred form, amounts reserved to be paid out on set price bets on that outcome are all of the said amounts and amounts bet on that outcome include all of the variable price bets.

In one preferred form, amounts reserved to be paid out on set price bets on that outcome are a portion of the said amounts and, amounts bet on that outcome include the remainder of the corresponding set price bets and all of the variable price bets.

In one preferred form, amounts reserved to be paid out on set price bets on that outcome are none of the said amounts and, amounts bet on that outcome include al of the set price bets and all of the variable price bets.

In another preferred form, amounts reserved to be paid out on set price bets on that outcome are all of the said amounts prior to the current set price bet and, amounts bet on that outcome include the current set price bet and all of the variable price bets.

In one preferred form, the equations and/or parameters are restricted to those which produce prices for each outcome that are representative of the amounts bet on that outcome.

In one preferred form, (such as may be the case for win and place betting), the prices for all possible outcomes are regularly determined and represented.

In another preferred form (such as may be the case for trifectas and fourtrellas), prices are commonly determined and represented for a much lesser number of outcomes (such as those requested by the punter) for such reasons as the practical difficulty of representing all possible outcomes or the lack of a necessity to do so. In another preferred form it may even be the case, particularly for variable price bets, that the prices are determined and represented for none of the outcomes at particular stages of the method. For example, in order to enhance price stability, the prices may be determined and represented only when the cumulative amount bet on any outcome exceeds a prescribed proportion of the bet limit.

The representation referred to is of a type suitable for use in and/or by the processor—such as signals stored in memory, on disk or tape or any such suitable type.

In one preferred form, the representation would also include a type which was visual in nature.

In other forms the representation would include types such as audio, tactile, some other suitable type or, some combination of the above.

The aim of a limit is to prevent a direct loss to the totalisator operator and preferably, an indirect loss as well. Without a mechanism which achieves this aim, the amount that could be paid out on any given bet could exceed the amount available, thereby resulting in a direct loss to the totalisator operator. In addition, an indirect loss could result from the negative response of punters to a system which allows adjustments to prices which are too large.

Any method consistent with the stated aim is acceptable. Even a simple mechanism such as nominating an amount that remains fixed throughout betting may suffice, although this is not a preferred option.

In one preferred form, the limit allows no more than a certain appropriate portion of the pool to be allocated to any one set price bet before there is an adjustment to the price to allow for that bet.

In one preferred form, a bet limit is calculated for each corresponding set price and a representation thereof is then produced in conjunction with a representation of that price.

In one preferred form, a subset of the pool of bets would be determined, a portion of that would be specified as a limit (the maximum amount to be paid out on a set price bet) and the bet limit would be determined from this amount by allowing for the price at which the set price bet must be paid.

In one preferred form, the subset is the gross variable pool after that has been divided amongst the number of results on which dividends must be paid and a certain proportion (L) of that is allocated to be paid out on a set price bet; the bet limit being determined from this amount by allowing for the rate of dividend at which the set price bet must be paid. Preferably, this is achieved by utilising either of the equations below:

$$\text{Bet Limit} = \frac{L \times TBV}{SD(X) \times NR} = \frac{L \times BV(X)}{(1 - VCR)}$$

In another preferred form, the subset is the pool of bets after it has been divided amongst the number of results on which dividends must be paid and, diminished to allow for commission and the amounts reserved to be paid out on set price bets on that outcome (the net pool); a proportion (L) of that is allocated as the maximum amount to be paid out on a set price bet, the bet limit being determined from that proportion by allowing for the rate of dividend at which the set price bet must be paid.

In the preferred embodiment, this is achieved by utilising the following equation:

$$\text{Bet Limit} = \frac{L \times \{(1 - SCR) \times (TBV + TBS + BN(Y)) - BC(Y) - PN(Y)\}}{SD(Y)}$$

which, after allowing for the definition of SD(Y), reduces to:

$$\text{Bet Limit} = L \times BV(Y)$$

which, as can be seen, is just a certain proportion of the amount bet on the given outcome on the variable pool.

It will be appreciated that if the method of the invention is followed, a set price bet will be prevented from being so large as to detract from commitments with precedence, such as commission and the amounts reserved to be paid out on previous set price bets on that outcome.

In one preferred form, ensuring that the amount reserved to be paid out on a set price bet does not exceed the pool of bets after it has been;

a) divided amongst the number of results on which dividends must be paid;

b) diminished to allow for commission;

c) diminished to allow for the amounts reserved to be paid out on previous set price bets on that outcome; is achieved by:

1/ensuring that a limit for that outcome does not exceed the pool of bets after it has been;

i) divided amongst the number of results on which dividends must be paid;

ii) diminished to allow for commission;

iii) diminished to allow for the amounts reserved to be paid out on previous set price bets on that outcome;

2/determining a bet limit for that outcome from the limit by allowing for the set price for that outcome;

3/ensuring that the amount of a set price bet does not exceed the bet limit.

In one preferred form, the set price and bet limit to be offered for the current set price bet are determined without allowing for the current set price bet in the calculations even though it is allowed for in determining variable prices.

In another preferred form, the set price and bet limit to be offered for the current set price bet, as well as variable prices, are determined by allowing for the current set price bet in the calculations. In practice, this may mean that the bet limit will not restrict the size of the set price bet because the price is adjusted downwards by the effect of the bet and helps to achieve the same aim as for the limit. In one preferred form, the process of allowing for the current set price bet in the calculations means including that bet in the variables which are used in calculating the set price for the current bet. But, in another preferred form, the process of allowing for that bet means that the bet would only be included in the said variables if the effect of cumulative bets on that outcome since the last recalculation is to change the price by a predetermined amount.

One method that may be used to ensure the set price obtained is acceptable to the punter is for him to specify, along with the other details of his bet, the minimum price which he will take. If this is done directly by him (say by his use of a touch-screen, a keypad or by using a card marked by him in conjunction with a card reader), it ensures that the responsibility for any mistake rests with him. To enable the punter to check the bet, the information relating to it could be put on a screen before consignment to the processor. While this method ensures the integrity of the system, it may well be regarded by the punter as cumbersome and less than satisfactory.

Confirmation of bets is the preferred method for overcoming the problems that result from a system which must process multiple transactions in a short space of time (including transactions for which the prices are set), and yet wishes to give punters the opportunity to reject any bet which is either not correct or for which the price is not acceptable.

One problem associated with this approach is that, of necessity, there will be a delay between the request for a set price bet and the confirmation of that bet. Consequently, other set price bets and variable price bets may be requested and/or processed in the interim. Therefore, at any one time, there may be a number of set price bets which have been requested but not yet confirmed.

In such a circumstance, if the bet(s) are either large or tend to be on one outcome (and this is not uncommon), the price offered for that outcome will be too generous unless it is adjusted downwards after each request for a set price bet. However, if the prices of other outcomes are adjusted upwards to reflect such a request, then any prices assigned to those other outcomes will be too generous if that bet is not confirmed. Unless a secure method is used in dealing with this problem, the potential for fraudulent manipulation of prices is considerable. In the preferred embodiment, the problem is countered by adjusting downwards the price of the outcome for which a set price bet is requested but not adjusting upwards the price for other outcomes (as a consequence of this bet) until the bet is confirmed. Consequently, the more quickly set price bets are confirmed, the better.

However, this solution presents its own problems. At times when there is an increased inflow of bets (which is not uncommon, especially just before an event), the prices of at least some if not all outcomes may be significantly depressed by the above process. While this may result in better prices for variable price punters because of the reduced set price commitment at these lower prices, it is nonetheless believed that any significant set price depression would not be desirable because of a likely negative reaction from punters.

Any excessive depression of prices due to this effect could be countered by means of a compensating mechanism. One preferred method is a price stabilisation technique which adjusts prices at such times. In one preferred form, the degree of adjustment of prices is based upon the sum of the reciprocals of the most recently quoted set dividends (prior to the quote which results from the inclusion of the current bet). It is believed that use of a compensating mechanism would not usually be necessary because the degree of price depression would generally be small. This would be especially so if, as is believed, the provision of set prices according to this invention significantly reduces demand at peak times such as just prior to a race.

In one preferred form, at least two types of records of every bet would be produced: a computer record which may include both electronic storage in memory and magnetic storage on disk or tape and; a record for the punter which may be in the form of a printed ticket, magnetic storage or some other suitable means.

In one preferred form, the information recorded in relation to a bet would be selected from information relating to the type of meeting (e.g. gallops, trots, dogs, athletics, football), the venue, the date, the event identification (e.g number), the outcome identification (e.g number and/or name of a competitor), the amount of the bet, the price and the type of bet (e.g. win, place).

It will be appreciated that as the variable prices are determined by a process which allows for all of the commitments with precedence before an apportionment is made to variable price bets (where the rate of return is flexible), there is virtually no chance that the system could either lose or fail to provide the full rate of commission.

A differential commission rate (with a lower commission rate for variable price bets), in conjunction with the set price system, is a preferred option and has a number of advantages which include:

a) The lower commission rate (and consequently better prices) will attract funds to the variable price pool.

It is highly desirable to attract sufficient funds to this pool and especially at an early stage in betting so as to provide a solid base against which set price punters can bet; the bigger the variable price pool, the bigger the set price bets that can be accommodated without affecting the prices significantly. Perhaps the ideal situation would be to have the pool evenly divided between set and variable price amounts.

Further enticements such as bonus dividends, discounts, free entrance to lotteries or vouchers for extra bets could be offered to punters who bet early and, restrictions on set price betting such as with regard to time and place could be imposed should that be deemed desirable. Without such incentives and/or restrictions, it is believed that the variable pool would diminish considerably, which in turn would significantly restrict the application of the system.

While set price punters will face a higher commission rate, this is not believed to be a great disadvantage—either to the system (because of the popularity of set prices) or to set price punters (because they may receive the price before it is adjusted downwards and because they have the advantage of choosing when they will bet, namely when they believe a price has reached a peak).

b) By offsetting the commission rate against the opportunity to obtain a certain dividend and the best price provides a fairer system than is often currently employed.

c) A reduced commission rate on the variable pool and therefore a more competitive final price will have a significant effect on illegal operators such as S.P. bookmakers. Such people offer the final price, either bookmakers' starting prices or final tote prices, sometimes with discounts or incentives. The lower the commission rate on the final price displayed and made available to the public, the more difficult these operators will find it to survive and the less desire the general public will have to bet with them.

d) The general availability of set prices will also reduce the incentive punters have to bet with such people. Consequently, there will be an increase in turnover in the authorised pools and a greater return to the racing industry and community in general.

There are many ways in which the commission rate(s) and the prices can be adjusted. One of the simplest and most effective ways is by varying the values of A and/or B in the following initial equation:

$$SVD(Y) = \frac{1}{BV(Y)} \times \left\{ \frac{A \times TBV + B \times TBS}{NR} - PC(Y) \right\}$$

Using A=1−VCR for the variable price equation and A=1−SCR for the set price equation and B=1−SCR for both, the following two equations emerge—the basic forms used in the preferred embodiment (except that bet confirmation has been added):

$$VD(Y) = \frac{1}{BV(Y)} \times \left\{ \frac{((1 - VCR) \times TBV + (1 - SCR) \times TBS)}{NR} - PC(Y) \right\}$$

$$SD(Y) = \frac{1}{BV(Y)} \times \left\{ \frac{((1 - VCR) \times TBV + (1 - SCR) \times TBS)}{NR} - PC(Y) \right\}$$

And, as the explanation in the preferred embodiment is for win bets where NR=1, the equations simplify even further to:

$$VD(Y) = \frac{((1 - VCR) \times TBV + (1 - SCR) \times TBS) - PC(Y)}{BV(Y)}$$

$$SD(Y) = \frac{((1 - SCR) \times TBV + (1 - SCR) \times TBS) - PC(Y)}{BV(Y)}$$

The application of either of these pairs of equations would yield a rate of return which is an average of VCR and SCR A more general version of the initial equation has the following form:

$$SVD(Y) = \left\{ \frac{(A \times TBV + B \times TBS)}{NR} - C \times PC(Y) \right\} \times \frac{1}{D \times BV(Y) + E \times BS(Y)} - F$$

where the parameters A–F (discussed in the appendix) are adjustable by the totalisator operator, while these values may be changed during betting (and may even be functions of other values), preferably they would not.

This form may be more convenient on occasions even though it can be shown to be mathematically equivalent to the initial equation and can be reduced to the same. As each of the parameters may be set so as to, in effect, change the commission rate, this form provides a greater degree of flexibility with respect to providing a smooth, advantageous change to prices. For example, set prices could be depressed compared to variable prices at the beginning of betting by setting D (for the set price equation) to a value slightly greater than 1. However, as betting proceeds and PC(Y) in from zero, the effect of D will be to also lower that value and prices will tend to increase for that reason. This will provide a greater price differential in favour of variable prices early in betting, thus attracting funds to the variable pool at that time and therefore providing a more stable pool against which set price punters can bet.

While in theory, various values can be chosen for each parameter and various combinations of parameters may be arranged, in practice the constraints on the system mean that only relatively few combinations are practicable.

In particular, there is the compulsory constraint that the total amount to be paid out on an outcome must not exceed the total amount available; this constraint ensures that the full rate of commission (whatever the desired rate and by whatever combination of parameters it is arrived at) is able to be paid and it will limit the combinations that can be used.

A highly desirable constraint is that the prices are representative of the amounts bet on a given outcome (and therefore representative of the demand for that outcome). The greater the variation from this constraint, the less useful the particular process will be.

The system provides and can maintain a differential between set and variable prices. Without this capability, the ability to offer set prices to all punters would be significantly restricted. Therefore, this highly desirable constraint further restricts the available combinations of parameters.

The following equations are some additional examples of the ways in which the general equation can be applied. In most instances both here and generally, the form of the general equation would be the most useful for the set price equation but, this is not exclusively so.

$$VD(Y) = \frac{1}{BV(Y)} \times \left\{ \frac{(1 - VCR) \times TBV + (1 - VCR) \times TBS}{NR} - PC(Y) \right\}$$

$$SD(Y) = \frac{1}{BV(Y)} \times \left\{ \frac{(1 - SCR) \times TBV + (1 - SCR) \times TBS}{NR} - PC(Y) \right\}$$

These equations are similar to those used in the preferred embodiment However, in this form, the rate of return is VCR.

An allowance for payment of successful set price bets may be made by manipulating PC(Y) or BS(Y) or both One way of avoiding an overlap of this allowance is to set E=1−C in the general equation:

$$SVD(Y) = \frac{1}{D \times BV(Y) + (1 - C) \times BS(Y)} \times \left\{ \frac{A \times TBV + B \times TBS}{NR} - C \times PC(Y) \right\}$$

Examples of this type of equation include:

$$VD(Y) = \frac{1}{BV(Y)} \times \left\{ \frac{(1 - VCR) \times TBV + (1 - SCR) \times TBS}{NR} - PC(Y) \right\}$$

$$SD(Y) = \frac{1}{BV(Y) + BS(Y)} \times \left\{ \frac{(1 - SCR) \times TBV + (1 - SCR) \times TBS}{\mathrm{NR}} \right\}$$

and;

$$VD(Y) = \frac{1}{BV(Y)} \times \left\{ \frac{(1 - VCR) \times TBV + (1 - SCR) \times TBS}{NR} - PC(Y) \right\}$$

-continued $$SD(Y) = \frac{1}{BV(Y) + (1 - C) \times BS(Y)} \times \left\{ \frac{(1 - SCR) \times (TBV + TBS)}{NR} - C \times PC(Y) \right\}$$

The commission rate may be determined or modified by methods other than just by manipulating the parameters in equations. Examples of other methods include:

a) Taking a subset of one or more of the variables. For example, the commission rate could be increased by including in TBV and/or TBS, only the amounts which correspond to bets over a certain value (say over $2). Of course, the commission rate would be a little less predictable than by varying parameters such as A or B but nonetheless, such a method may be useful.

b) Using theoretical bets. Set and/or variable price bets could be used, for example, by including them in BV(Y) and/or BS(Y) and/or PC(Y) but not including them (in part or in total) in TBV and/or TBS. Another approach is to include a theoretical bet in the calculations in the same way as for an actual bet but to only include it for the outcome for which the price is being calculated. If such theoretical bets are a function of the amounts actually bet on each outcome rather than a constant figure for all outcomes, then the prices will remain representative of the amounts actually bet on those outcomes; this is a preferred approach. Many such methods would equate to varying A and/or B but others would give slightly different results.

In one preferred form, the method further includes repeating at least steps b) and c) when a variable or parameter changes.

After a calculation for an outcome, a visual or other such representation could be updated to reflect the latest values for the variables. However, because of the rapidly changing nature of some of the values, updating them only periodically (as is done in the preferred embodiment) would be more appropriate—one possibility would be every 5–10 seconds and/or after the cumulative amount bet on any outcome (at both variable and set prices combined) exceeded a given fraction of the bet limit.

Instead of recalculating with every bet, it would also be possible to continue to assign the current price to set price bets as long as a prescribed amount, such as a given fraction of the bet limit, has not been exceeded by cumulative bets on an outcome (at variable and/or set prices) and, only recalculate and change the displayed information when it has.

In carrying out the calculations, speed enhancing techniques may be used such as the use of multiple processors, performing appropriate calculations simultaneously, only recalculating the prices if certain thresholds are reached, avoidance of floating point arithmetic where appropriate and buffering of processor output.

In some situations, punters in general may become quite dissatisfied if a series of larger set price bets are made in quick succession on a given outcome, resulting in its price suddenly shortening—a "plunge".

One way of reducing this potential problem is to reduce the bet limits. Another method is to ensure that the pools are as large as possible and one way of doing this is by adding together pools from various localities so that most large bets will not cause a significant problem.

However, in some instances (such as where small pools are inevitable), these solutions may not be adequate. Therefore, it is proposed that in one preferred form, a plunge modulation factor be introduced which would adjust the bet limit.

The object of this modification is to ensure that if a large bet is made, a reasonable amount of time elapses during which punters who make average size bets can do that without the price decreasing much further. Any method consistent with the stated aim would suffice. including setting the bet limit to a specified fraction of the original bet limit for a certain period of time after any large bet as well as precluding sequential bets on a given outcome by the same punter at any given terminal.

One preferred method of achieving the objective is to reduce the bet limit for a given outcome by a factor related not only to the size of the large bet but also related to the number and relative size of the bets made subsequently on that outcome.

In one form of this modification, a weighted running average (RA) of the amounts of the most recent set price bets on outcomes relative to their bet limits is first determined in the following way:

RA=RT/W where:

RT=WF×RT+B

W=WF×W+LB

WF=0.98

B=amount of the current bet.

LB=bet limit corresponding to the current bet.

The initial settings are values towards which these variables would tend, assuming that the values for B and LB were average historical values; RT tends towards B/(1−WF) and W tends towards LB/(1−WF). RA gives a snapshot, weighted towards the most recent bets, of the average fraction of the bet limit that bets made on the system represent.

A weighted running average of the set price bets for each outcome is also maintained in much the same way:

RA(X)=RT(X)/W(X) where:

RT(X)=WFX×RT(X)+B(X)×{B(X)/AB(X)}

AB(X)=RA×BL(X)=the expected average bet for this outcome based on the average fraction of the bet limit of bets on other outcomes.

WCX)=WFX×WX)+1

WFX=0.90

B(X)=amount of the current bet.

BL(X)=the bet limit corresponding to the current bet.

MBL(X)=BL(X)/{RA(X)/AB(X)}=the modified bet limit.

MBL(X) replaces BL(X) except where MBL(X) is greater than BL(X). Proceeding on the assumption that B(X) has the value which corresponds to the average fraction of the bet limit (AB(X)), the initial values are set to the values towards which these variables would tend: AB(X)/(1−WFX) for RT(X) and 1/(1−WFX) for W(X). When confirmation of bets is used and a bet fails to be confirmed, the figures are recalculated from that bet onwards by using previously stored values and by ignoring bets that have since lapsed.

Also in accordance with one aspect of the present invention, there is disclosed a set price totalisator betting apparatus providing set price and/or variable price betting by operating on a pool of bets and ensuring that the total amount to be paid out on an outcome does not exceed the total amount available, the said apparatus comprising:

a) input means that receives data relating to each bet;

b) processing means to determine set and/or variable price(s) for none, one or more of the possible outcomes by operating on the pool of bets;

c) memory means for storing instructions, said data and information derived therefrom;

d) representing means to represent information relating to each outcome so calculated; and e)recording means to produce records of totalisator bets with set prices assigned to those which are for set price bets;

thus delivering a set price totalisator.

In one preferred form, the processing means would include means for calculating a set price limit and/or bet limit for each corresponding set price and the representing means would include means for representing the same.

In one preferred form, the information relating to each outcome to be represented would be selected from the date, the type of meeting, the type of bet, the amount bet, the set and variable prices, the limit, the bet limit, the size of the variable price pool, the size of the set price pool, as well as information identifying the venue, the event(s) and the outcome(s) (and/or competitor(s)).

In determining the final form of information to be displayed, any suitable method may be used such as truncation or rounding.

There are a number of matters where the treatment of set price betting is different than for variable price betting.

Late Scratchings

In the case where there is only variable price betting, when a competitor is withdrawn after betting has commenced, the bets on an outcome involving that competitor are often removed from the pool and refunded. The prices are then recalculated on the modified amounts in the pool.

However, for set price betting, the prices already assigned to other outcomes will be greater than what they would have been if the scratched competitor had not been in the field at the time. The party which funded the original set prices (either the operator of the betting system or, as here, the variable price punters) needs to be compensated for the bets that have to be refunded on outcomes involving the scratched competitor.

One way of dealing with this problem is to have deductions from successful bets that were made prior to the withdrawal and one way of deciding on the level of the deduction is to base it on the last price of the scratched competitor; the deduction being based on the reciprocal of the dividend e.g. for win bets, 25 c in the dollar for a dividend of 4.0. This method is commonly used when the operators of the betting system are bookmakers. This method would also be used in one form of the current invention.

However, with computerised set prices, more accurate methods are possible. The following method is the one used in the preferred embodiment The rate of deduction from the set dividend on any given outcome (to be actually deducted only if the bet is successful) is calculated according to the following formula:

$$\frac{(1-SCR)\times BS(X)+(1-VCR)\times BV(X)}{(1-SCR)\times TBS+(1-VCR)\times TBV}$$

where X is the number of the competitor which was scratched, all of the variables have the values that existed immediately prior to the removal of the bets involving that competitor and BS(X) and BV(X) would comprise any bets involving the scratched competitor.

In order to recalculate the current prices for a given outcome, this rate of deduction is applied to all set price bets made on that outcome prior to the removal of the bets involving the scratched competitor. The total amount calculated as being deductible is added back into the pool available for distribution on that outcome after the bets involving the scratched competitor have been subtracted and, after the pool has been divided amongst the number of results on which dividends must be paid and diminished for commission. The prices are then recalculated.

Dead Heats

Allowance for dead heats has to be made when more dividends than usual need to be paid on a result. This happens when at least one extra competitor has a claim to a position which is decisive of whether a dividend is paid or not e.g. for win dividends, where two competitors dead heat for first place.

In this situation, the set dividend involving each dead heater is divided by a factor which is determined by the number of dead heaters. In the above example of two competitors dead heating for first place, each dividend is divided by two.

Minimum Dividends

In jurisdictions which require that a minimum dividend be paid, this can be specified for set prices as well It will impact on variable prices as would any other specified set price and will impact on other prices and the rate of return in the same way as would a minimum dividend in the usual variable price situation.

BRIEF DESCRIPTION OF THE DRAWINGS

To further assist in an understanding of the invention as well as the features and advantages thereof, reference will now be made to the Preferred Embodiment of the same, the description of which should be read with reference to the accompanying figures.

BEST METHOD FOR CARRYING OUT THE INVENTION

Preamble

A different rate of commission for variable price bets (say 10%) and set price bets (say 20%) is adopted in the preferred embodiment described herein.

The example chosen to illustrate the best method is that of win bets made on a race. Consequently, the terminology used is for that situation e.g. the amount bet on a competitor (to win). In a description of other types of betting, the bet would be referred to as being on a particular "outcome".

Operation of the Invention

Figure 1A:
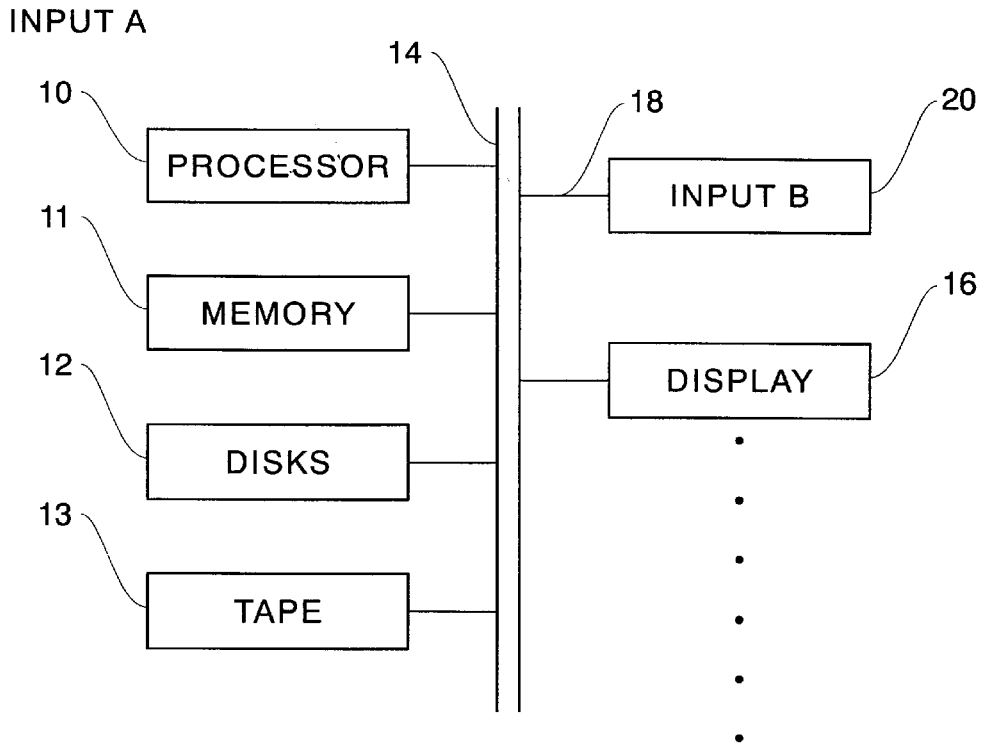
FIG. 1A is a block diagram of a system configuration to enable implementation of the processing method of the invention.

FIG. 1A is a block diagram which illustrates the general operation of the invention. Connected to the input/output (I/O) bus 14 is the processor 10 which has central control of all processing. It converts data coming in via line 18 from the input circuit 20 (INPUT B) to all other necessary data, including that routed to display 16.

Memory 11 is also connected to the I/O bus 14 and provides temporary storage for data and addresses and may also provide storage for the software instructions used to operate the processor 10.

Various peripherals may also be attached to the I/O bus 14. For example, storage devices such as disks 12 and tape 13 may be connected.

Typically there would be a number of sources of input and a number of pieces of display apparatus. The sources of input could be individual terminals having direct access to the central processor.

Figure 1B:
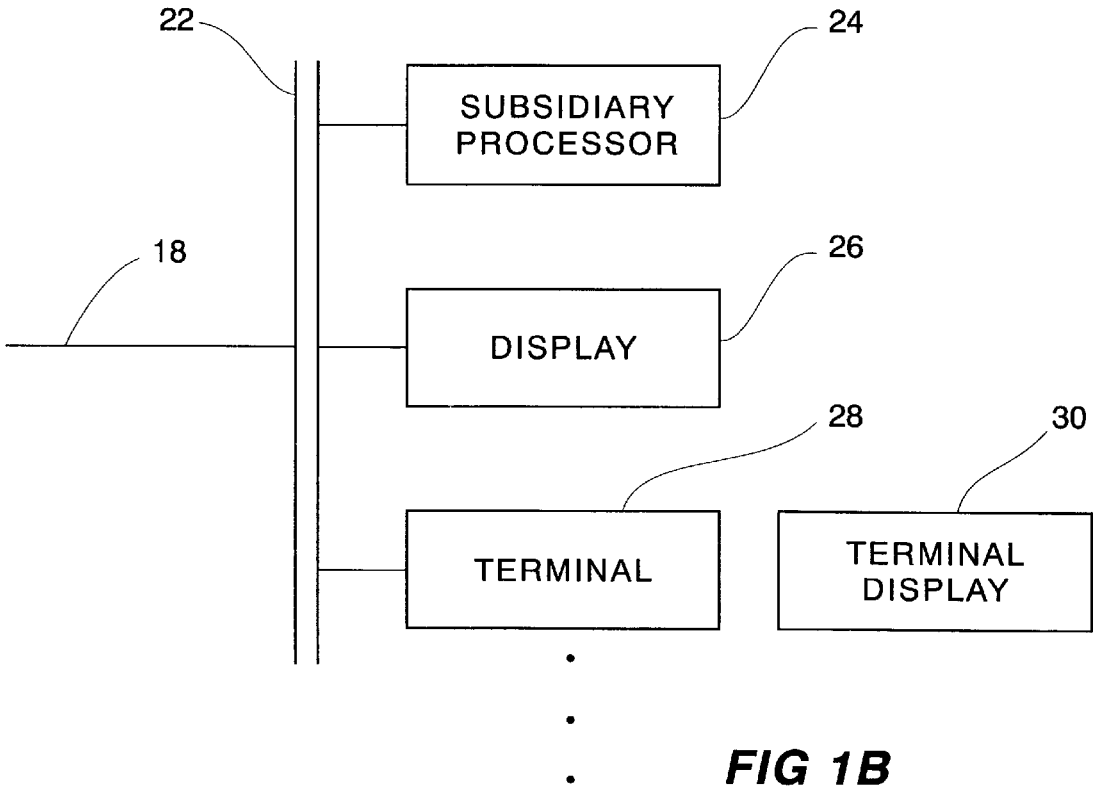
FIG. 1B is a block diagram of an alternative system configuration to enable implementation of the processing method of the invention.

In an alternative arrangement, the sources of input could be subsidiary processors 24 as illustrated in FIG. 1B. Typically, such subsidiary processors would be situated in different geographical localities (such as different cities or states) and collate data from a number of terminals 28. There may also be displays 26 connected (via I/O bus 22) to, and controlled by, each subsidiary processor.

Figure 2A:
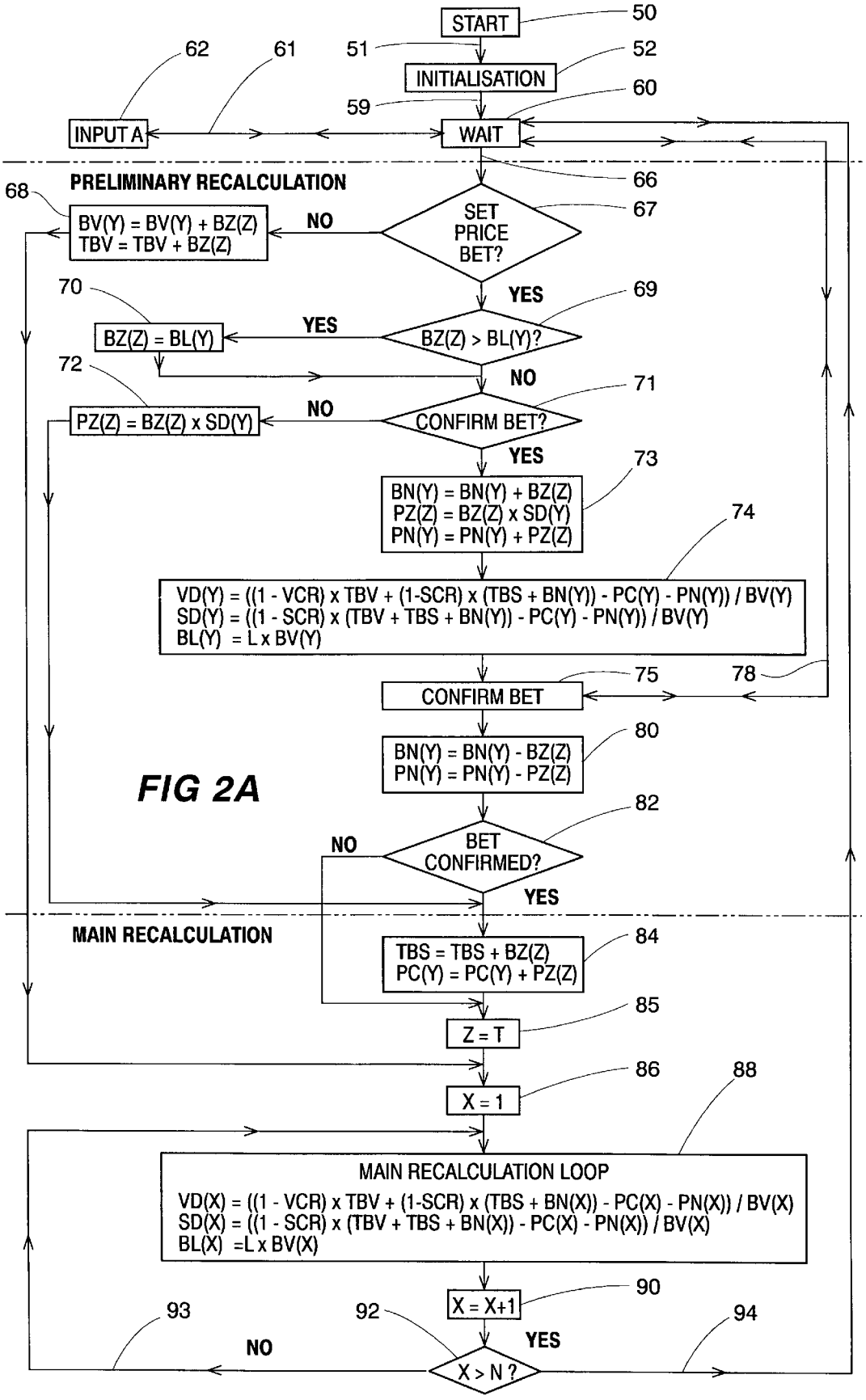
FIG. 2A is a flow chart showing an algorithm in accordance with the present invention.
Figure 2B:
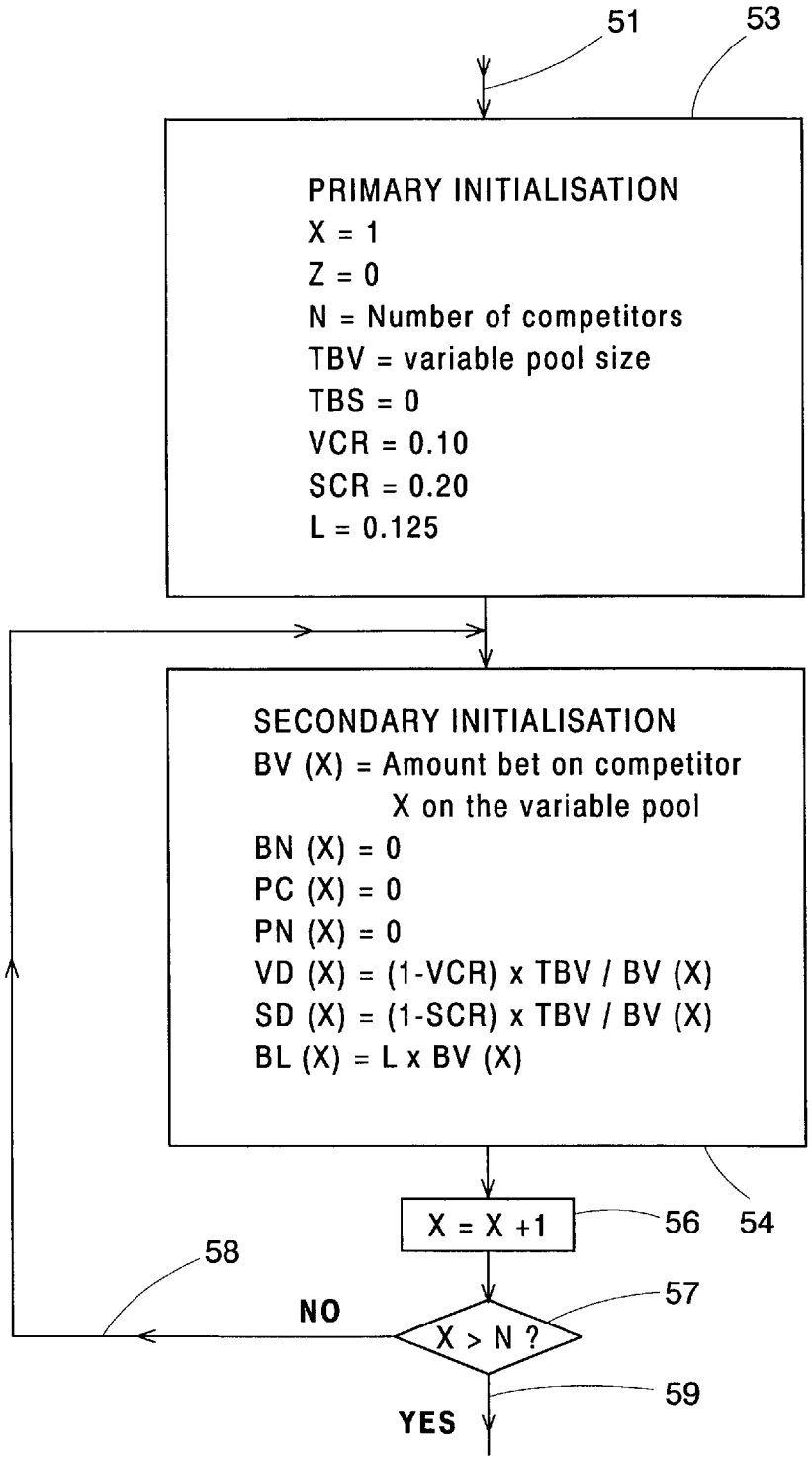
FIG. 2B is a flow chart showing in more detail the initialisation procedure of the algorithm shown in FIG. 2A.

Each terminal 28 has its own terminal display 30. This facilitates rapid decision making on the part of the punter if he is asked to confirm a set price bet as described herein; it is envisaged that the display would show all necessary information for the making of that decision and in particular, the price allocated to the requested set price bet Initialisation The process is started at step 50 which is after the number of bets received on the variable price totalisator is sufficient to provide a stable pool against which set price punters can bet Generally that would happen about 30–45 minutes prior to a race. Processing sequences via line 51 to step 52 which is further explained in FIG. 2B. The first part of this process is shown at step 53. The counter X, which incrementally counts the competitors, is set equal to one and the bet counter, Z, is set to zero. N is set equal to the number of competitors and TBV is set equal to the amount that has been bet in the variable pool. As there have been no bets on the set price portion of the totalisator at this stage, the amount in the confirmed set price pool, TBS, is set to zero.

The commission rates can, in theory, be given any decimal values between zero and one but the optimum values are believed to be 10% for the variable pool and 20% for the set pool. Hence VCR is set equal to 0.10 and SCR is set to 0.20. The optimum value for the maximum proportion of the net pool available for distribution that can be allocated to be returned to the set price punter if the bet is successful is believed to be about 12.5% and so L is set to 0.125.

At step 54, the values of the variables are set for each competitor in turn by means of a loop. It should be noted that in this description of the invention, data for each competitor is described as being stored in variables and commonly, as at step 54, in the form of one dimensional arrays. This manner of storage of data is but one possible way of doing so.

Firstly therefore, the appropriate values for the first competitor on the list (X=1) are set BV(X), here as BV(1), is made equal to the amount bet on the first competitor on the variable price totalisator. In the unlikely event that the amount bet on a competitor is nil, one preferred approach would be for a nominal amount to be placed on that competitor by the totalisator operator so as to avoid undefined values in the calculations. Or, some other mechanism could be used such as sidestepping the calculations in that situation and assigning a price and bet limit to that competitor. As the amount bet on any competitor on the set price portion of the totalisator to this point in time is nil, BN(1) is set to zero. Similarly, the amount reserved to be paid out on the set price portion of the totalisator on any competitor to this point in time is nil and so PC(1) is set to zero. Likewise PN(1)=0.

Also at step 54, the variable dividend VD(1) and the set dividend SD(1) are calculated according to the equations:

$$VD(X) = \frac{(1 - VCR) \times TBV}{BV(X)} \text{ i.e } VD(1) = \frac{0.90 \times TBV}{BV(1)}$$

$$SD(X) = \frac{(1 - SCR) \times TBV}{BV(X)} \text{ i.e } SD(1) = \frac{0.80 \times TBV}{BV(1)}$$

In addition, the set price bet limit for the first competitor is calculated according to the equation:

$$BL(X)=L\times BV(X)=0.125\times BV(X)=BL(1)$$

In this way, if a bet of the limit amount is successful, a maximum of 12.5% of the net pool available for distribution is returned to the set price punter on this bet and at this price. Because this amount is no longer available to be returned to the variable price punters who have bet on this competitor, the price that they are to receive is lowered (as explained below).

All the relevant variables for the first competitor (X=1) have now been initialised and so, at step 56, the counter X is incremented so that the values for the next competitor can be set Next is the decision step 57 where it is asked whether X is larger than the number of competitors, N. If it is not, as here, then processing returns via line 58 to step 54 and the process is repeated for that next competitor. However, if X is greater than N, this will be because the variables for every competitor have been computed, and processing will move on via line 59 to step 60 where processing pauses until there is input via line 61 from step 62.

Figure 2C:
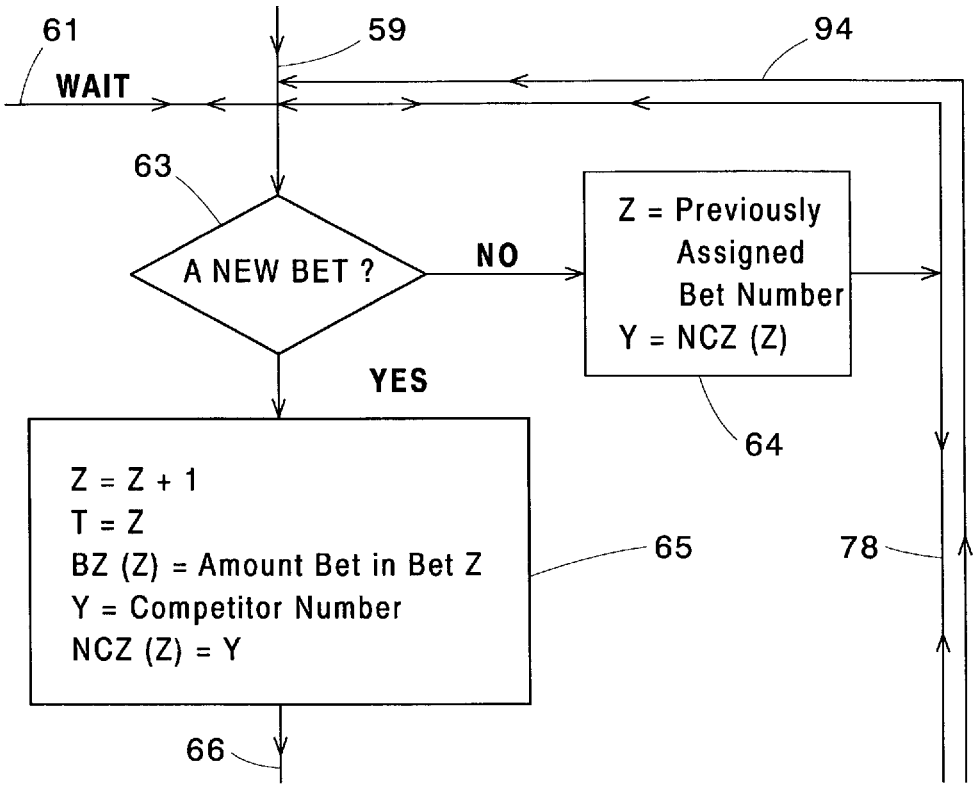
FIG. 2C is a flow chart showing in more detail the procedure instituted as each bet is processed by the algorithm shown in FIG. 2A.

Step 60 is further explained in FIG. 2C. Immediately after initialisation, the first input received will be a new bet. So, at decision step 63, the answer will be yes and processing will continue at step 65. This will be the case no matter whether the bet is a variable price bet or a set price bet At step 65, Z is incremented and T is set equal to Z So, for the first bet, Z will be equal to one. BZ(1) will be set equal to the amount of the bet, even if at this stage it is only requested (by virtue of the fact that it is a set price bet). Y and NCZ(Z) are both set equal to the number of the competitor selected by the punter. Processing then continues via line 66 to step 67.

Preliminary Recalculation

As stated previously, because there will inevitably be a delay between the request for a set price bet and the confirmation of that bet, at any one time there may be a number of set price bets which have been requested but not yet confirmed. It is the function of variable BN(Y) to store the total amount of those bets on competitor Y and the function of PN(Y) to store the total amount reserved to be paid out on the same bets should that competitor win.

The input coming in to step 60 from Input A via line 61 could be a new bet; in the form of a variable price bet, a request for a certain amount to be bet as a set price bet or a set price bet which is confined as it is bet. Or, it could be the confirmation, rejection or lapsing of a previous set price bet. If it is a new bet, then at step 67 it is decided which type of bet it is.

If it is a variable price bet, the calculations at step 68 are performed which add the amount of the bet to both the amount bet on the variable price portion of the totalisator on this competitor, BV(Y), and the total amount bet on the variable price portion of the totalisator, TBV, i.e.

$$BV(Y)=BV(Y)+BZ(Z)$$

$$TBV=TBV+BZ(Z)$$

It should be noted that as variable price bets do not need to be confirmed with regard to price, they are immediately added to the amount in the committed pool; any checking of the bet is done prior to it being consigned to the processor for inclusion in the committed pool.

This is achieved by means of a confirmation process. As a bet is input (either by an operator to whom the bet is called or directly by the punter by means such as a touch-screen, a keypad or a card reading device), the details of the bet appear on the terminal display 30. Multiple bets could be input in this way, if desired, prior to confirmation and the punter would be able to confirm the bets on the screen at any time by, say, pressing a button. Any errors could be corrected by the operator or, by the punter directly by means of a touch-screen or a keypad. There would be no time limit for confirmation of variable price bets.

Bet confirmation prevents the fraudulent manipulation of prices that would be allowed by other processes such as those which simply prevent the cancellation of bets after certain events have occurred.

In order to avoid the problem of a punter not paying for bets, especially large bets which may be used to manipulate prices, payment would be required before the bets are allowed to be confirmed. The payment could be made in the form of cash or by some other means such as a "smart" card or direct access to an account containing funds and, the terminal would refuse to confirm any bets for which funds had not been made available.

After the calculations mentioned above, processing branches directly to step 86.

If it is a set price bet then a decision is made at step 69 as to whether the requested bet is greater than the bet limit If it is then processing diverts to step 70 where the bet amount BZ(Z) is set equal to the bet limit for competitor Y, namely BL(Y), and processing moves on to step 71. However, if the requested bet is not greater than the bet limit, processing advances directly to step 71.

Step 71 tests whether the punter requesting the set price bet wishes to accept the bet forthwith (sight unseen), or whether he wishes to have the opportunity to reject or confirm it (once the price and amount of the bet are displayed) by entering the confirmation procedure. Either way, to avoid the problem of a punter not paying for bets, in much the same way as for variable price bets, payment would be required before the bets are confirmed and preferably before they are even requested (so as to discourage frivolous bets or bets aimed at manipulation).

If the punter does not wish to enter the confirmation procedure, processing branches to step 72 where the amount to be paid out if the bet is successful is calculated according to the equation:

$$PZ(Z)=BZ(Z)\times SD(Y)$$

Processing then goes directly step 84.

If he does want to enter the confirmation procedure, processing moves on to step 73 where the amount of the bet is added to the total amount of set price bets which have not yet been confirmed, namely BN(Y). And, the amount to be paid out on bet Z should competitor Y win, namely BZ(Z) ×SD(Y), is recorded in PZ(Z) and added to the total such amount as yet unconfirmed for Y in PN(Y). That is:

$$BN(Y)=BN(Y)+BZ(Z)$$

$$PZ(Z)=BZ(Z)\times SD(Y)$$

$$PN(Y)=PN(Y)+PZ(Z)$$

Processing then advances to step 74 where the following calculations are performed:

$$VD(Y)=\frac{(1-VCR)\times TBV+(1-SCR)\times(TBS+BN(Y))-PC(Y)-PN(Y)}{BV(Y)}$$

$$SD(Y)=\frac{(1-SCR)\times(TBV+TBS+BN(Y))-PC(Y)-PN(Y)}{BV(Y)}$$

$$BL(Y)=L\times BV(Y)$$

The explanation for these equations is as follows:

As indicated previously, the basic formula for the win dividend (where NR=1) on a pure variable system is:

$$VD(Y)=\frac{(1-VCR)\times TBV}{BV(Y)}$$

For the set price totalisator, the calculations are more complex; the amount calculated as being available to be paid out to variable price punters, namely (1−VCR)×TBV, is increased by the total amount bet (and confirmed) on the set price portion of the totalisator as well as by the amount bet (but as yet unconfirmed) on this competitor on the set price portion of the totalisator, after deducting the appropriate commission ie. increased by (1−SCR)×(TBS+BN(Y)). However, this total available to be distributed to variable price punters (and subsequent set price punters up to the limit) is reduced by the amounts already reserved for set price punters on this competitor whether confirmed, PC(Y), or yet to be confirmed, PN(Y).

The same principles are adopted for the calculation of the set dividend, SD(Y), except that the set price commission rate, SCR, is used as if it applied to all the amounts bet and included in the calculations.

The bet limit, BL(Y), is then calculated from the amount bet on this competitor on the variable portion of the totalisator.

It should be noted that the only prices recalculated at this point are those for the competitor on which the set price bet was made.

This method of calculating the prices (and bet limits) is but one way of doing so and has been adopted as the preferred approach because it is conservative. A less conservative method that could be adopted is to add to the amount available to be paid out, not only the amount bet on this competitor which is yet to be confirmed but that amount for all other competitors as well ie. the values of BN(Y) for all values of Y in the form of a running total of the same. This would give slightly more generous prices but those prices would be overly generous if a significant and unrepresentative quantum of bets on some other runner(s) were not confirmed (as may well happen in practice).

At step 75, procedures are instituted to attempt to confirm the bet and processing diverts via line 78 to step 60 where a message is sent to the appropriate terminal 28 and its display 30. It should be noted that in this embodiment, the price offered to the set price punter is the one that existed immediately prior to the recalculation at step 74 and is conveniently evaluated by the expression:

Set Dividend Offered=PZ(Z)/BZ(Z)

The quantum of the bet offered is given by the current value of BZ(Z).

At this point, while waiting for a reply with regard to bet Z, the processor may well accept input of new bets or confirmation of previous bets (if this is not the first time a set price bet has been processed). If there is no confirmation of the current bet within a specified time, and in the preferred embodiment this would be about 5 seconds, the bet would be registered as unconfirmed.

Whether confirmed or not, as soon as a decision is made and bet Z moves to the head of the processing schedule, it is decided at step 63 whether the bet is a new bet or not. As it is not, processing moves on to step 64 where Z is given the number previously assigned to this bet and Y is made equal to the competitor number selected by the punter, namely NCZ(Z).

Processing then reverts back via line 78 to step 75 and on to step 80. At this point, the bet can no longer continue to be validly included in the temporary pool. This is so whether the bet is confirmed or not; if confirmed then the bet becomes a permanent bet and if not the bet lapses. Therefore, the variables temporarily storing the total amount bet on this competitor, BN(Y), and the total amount reserved to be paid out, PN(Y), have to be adjusted to remove the effect of the bet The calculations at step 80 are performed to accomplish this:

$$BN(Y)=BN(Y)-BZ(Z)$$

$$PN(Y)=PN(Y)-PZ(Z)$$

Processing then moves on to step 82 where it is ascertained whether the bet has been confirmed or not If it has not, processing diverts directly to step 85. However, if the bet has been confirmed, processing moves on to step 84 where, by means of the following calculations, it is included in the permanent pool of bets:

$$TBS=TBS+BZ(Z)$$

$$PC(=PC(Y)+PZ(Z)$$

Processing now moves on to step 85 where Z is reset to the bet number of the last new bet i.e. Z=T.

As a preliminary to entering the main recalculation loop 88, the variable X is set equal to 1 at step 86.

In the main recalculation loop itself (step 88), the variable dividend, VD(X), the set dividend, SD(X), and the bet limit for a set price bet, BL(X), are calculated for each competitor in turn. The principles relating to these calculations are essentially the same as those employed in relation to step 74. That is, at step 88 the following calculations are performed:

$$VD(X) = \frac{(1-VCR)\times TBV+(1-SCR)\times(TBS+BN(X))-PC(X)-PN(X)}{BV(X)}$$

$$SD(X) = \frac{(1-SCR)\times(TBV+TBS+BN(X))-PC(X)-PN(X)}{BV(X)}$$

$$BL(X) = L\times BV(X)$$

The value of X is then incremented at step 90. So, after the first step, the value of X will be 2.

The next step at 92 is a decision step. If X is not greater than the number of competitors, processing returns via line 93 to step 88 and the calculations are repeated for the next competitor.

This process continues until the values for all competitors have been recalculated, at which point the value of X is greater than the number of competitors and processing goes via line 94 back to step 60 where the computer waits for input from Input A (step 62).

After the above calculations, the information displayed at locations such as 16 (and/or other locations such as 26) is updated periodically—say every 5–10 seconds and/or after the cumulative amount bet (both variable and set price) on any competitor exceeds a given fraction (say half) of the bet limit.

Although the invention has been described for the case of betting on a competitor winning an event and with reference to this specific embodiment, this description is not meant to limit the invention to this situation. Indeed, there is direct application of the invention to numerous other forms of betting. In addition, various modifications of this disclosed embodiment as well as other embodiments of the invention will become apparent to persons skilled in the art after referring to the descriptions contained herein or practising the invention.

Appendix

1) A—the parameter by which TBV is modified. Most practicable values will be less than 1 and greater than zero. In the preferred embodiment, A is 1−VCR and acts as one of the two commission deducting mechanisms.
2) B—the parameter by which TBS is modified. Most practicable values will be less than 1 and greater than zero. In the preferred embodiment, B is 1−SCR and acts as one of the two commission deducting mechanisms.
3) BL(X)—the current set price bet limit on competitor X.
4) BN()—the current total amount bet (on the set price portion of the totalisator on competitor X) for bets which are not yet confirmed.
5) BS(X)—the sum of all confirmed bets at a et price on competitor X
6) BV(X)—the total amount bet on the variable price portion of the totalisator on competitor X.
7) BZ(Z)—the amount bet on bet Z (whether requested or confirmed).
8) C—the parameter by which PC(Y) is modified. The value in the preferred embodiment is 1. Most practicable values will be from zero to slightly above 1.
9) D—the parameter by which BV(Y) is modified. Most practicable values will be close to 1 and in the preferred embodiment, exactly equal to 1.
10) E—the parameter by which BS(Y) is modified. The value in the preferred embodiment is zero. Most practicable values will be from zero to slightly above 1.
11) F—the parameter by which SVD(Y) is modified. Most practicable values will be close to zero and in the preferred embodiment, will be exactly zero.
12) L—the limited) proportion of a subset of the pool that is to be returned to a set price punter on a bet to the limit if that bet is successful.
13) N—the number of competitors.
14) NCZ(Z)—the number of the competitor on which bet Z has been made.
15) NR—the number of results on which dividends must be paid (e.g. 3 place dividends).
16) O(X)—the current variable adds for competitor X.
17) PC(X)—the total amount reserved to be paid out on the set price portion of the totalisator for bets which have been confirmed on competitor X (should it win).
18) PN(X)—the current total amount reserved to be paid out (on the set price portion of the totalisator on competitor X should it win) on bets which are not yet confirmed.
19) PZ(Z)—the amount reserved to be paid out on bet Z (if the bet is confirmed and if it is successful).
20) SCR—the et price commission rate.
21) SD(X)—the current set dividend for competitor X.
22) SVD(Y)—a variable which can represent either a set or variable dividend.
23) T—a variable which provides temporary storage for the number of the last new bet i.e. the highest value of Z so far.
24) TBS—the total amount bet (and confined) on the it price portion of the totalisator.
25) TBV—the total amount bet on the variable price portion of the totalisator.
26) VCR—the variable price commission rate.

27) VD(X)—the current variable dividend for competitor X. Generally the dividend is equal to the odds plus one (one unit of currency).

28) X—a variable used to count incrementally from the first to the last competitor in the field.

29) Y—a variable which is set equal to the number of the competitor on which the bet currently being processed has been made.

30) Z—a variable used to count incrementally from the first bet made after the set price totalisator has been initialised i.e. the bet number.

I claim:

1. A set price totalisator betting apparatus for providing variable price betting on one or more outcomes which is for bets with a price which is variable, and providing set price betting on one or more outcomes, including:

pool of bets establishing means for establishing a pool of bets which initially includes at least one variable price bet;

input means for receiving data relating to a bet;

set price providing means for providing a set price for an outcome;

recording means for providing at least one record of said bet; and commitment limitation means for committing an amount to be paid out on said outcome which does not exceed a prescribed amount available for payout upon eventuation of said outcome, where the maximum value of said prescribed amount available is said pool of bets after being diminished at least for:

a) commission; and b) the amounts reserved to be paid out on any previous set price bets on said outcome.

2. An apparatus according to claim 1 wherein the maximum value of said prescribed amount available is said pool of bets after being:

a) divided amongst the number of results on which bets must be paid out;

b) diminished to allow for commission;

c) diminished to allow for the amounts reserved to be paid out on any previous set price bets on said outcome.

3. A method of providing variable price betting on one or more outcomes which is for bets with a price which is variable, and providing set price betting on one or more outcomes, on a set price totalisator betting apparatus having input means for receiving data relating to a bet;

set price providing means; and recording means for providing at least one record of said bet;

said method including the following steps:

establishing a pool of bets which initially includes at least one variable price bet;

providing a set price for an outcome by the set price providing means; and committing an amount to be paid out on said outcome which does not exceed a prescribed amount available for payout upon eventuation of said outcome, where the maximum value of said prescribed amount available is said pool of bets after being diminished at least for:

a) commission; and b) the amounts reserved to be paid out on any previous set price bets on said outcome.

4. A method according to claim 3 wherein the maximum value of said prescribed amount available is said pool of bets after being:

a) divided amongst the number of results on which bets must be paid out;

b) diminished to allow for commission;

c) diminished to allow for the amounts reserved to be paid out on any previous set price bets on said outcome.

5. A betting apparatus for providing variable price betting which is for bets with a price which is variable, and for providing set price betting, including:

an input means for receiving data relating to bets;

a set price providing means for providing a set price for an outcome, wherein a bet at said set price has a potential payout liability; and a response means for producing a response to a predetermined condition occurring, said condition being such as to occur before the total potential payout liability on set price betting for said outcome exceeds the total of all the amounts bet diminished at least for commission, wherein the bets include at least one variable price bet, and said response enables said apparatus to be operated such that the total potential payout liability does out exceed the total of al the amounts bet diminished at least for commission.

6. An apparatus according to claim 5 wherein said condition is such as to occur before the total potential payout liability on set price betting for said outcome exceeds the total amount of all the bets diminished for commission and for allocation for at least one other outcome on which bets must be paid out, and said response enables said apparatus to be operated such that the total potential payout liability does not exceed the total amount of all the bets diminished for commission and for allocation for at least one other outcome on which bets must be paid out.

7. An apparatus according to claim 5 wherein said condition and said response are such that the total potential payout liability on set price betting does not exceed a prescribed amount, wherein said prescribed amount does not exceed the total of all the amounts bet diminished at least for commission.

8. An apparatus according to claim 5 wherein said set price providing means includes a set price input means for input of said set price for said outcome.

9. An apparatus according to claim 5 wherein said set price providing means includes a set price determining means for determining said set price for a current set price bet by allowing for said current set price bet.

10. An apparatus according to claim 5 wherein said set price providing means includes a set price determining means for determining said set price for said outcome which does not exceed the total of all the amounts bet:

a) diminished for commission;

b) diminished for the potential payout liability on previous set price bets on said outcome; and then c) divided by the total of the variable price bet amounts on said outcome.

11. An apparatus according to claim 5 further including a means to enable said apparatus to be operated so that a set price bet does not exceed a portion of the total of the variable price bet amounts on said outcome.

12. An apparatus according to claim 5 further including a bet confirmation means for confirming a bet so that said apparatus can be operated such that the total potential payout liability does not exceed the total of all the confirmed bet amounts diminished at least for commission.

13. An apparatus according to claim 5 further including a means to enable said apparatus to be operated such that a potential payout liability on a variable price bet or bets on an outcome does not exceed the total of all the amounts bet diminished for commission and for any payout liability on set price bets on said outcome.

14. An apparatus according to claim 5 further including a means to provide a higher rate of return to a person making a variable price bet on said outcome before a predetermined event or time than for a variable price bet on said outcome made after said predetermined event or time.

15. A method for providing variable price betting which is for bets with a price which is variable, and for providing set price betting on a set price betting apparatus having an input means for receiving data relating to bets; and a processor;

said method including the following steps:

providing a set price for an outcome, wherein a bet at said set price has a potential payout liability; and ensuring that the total potential payout liability on set price betting for said outcome does not exceed the total of all the amounts bet diminished at least for commission, wherein the bets include at least one variable price bet.

16. A method according to claim 15 wherein a predetermined condition is such as to occur before the total potential payout liability exceeds the total of all the amounts bet diminished at least for commission, and by responding to said condition occurring it is ensured that the total potential payout liability does not exceed the total of all the amounts bet diminished at least for commission.

17. A method according to claim 16 wherein said condition is such as to occur before the total potential payout liability exceeds the total of all the amounts bet diminished for commission and for allocation for at least one other outcome on which bets must be paid out, and by responding to said condition occurring it is ensured that the total potential payout liability does not exceed the total of all the amounts bet diminished for commission and for allocation for at least one other outcome on which bets must be paid out.

18. A method according to claim 15 wherein the total potential payout liability does not exceed a prescribed amount, wherein said prescribed amount does not exceed the total of all the amounts bet diminished at least for commission.

19. A method according to claim 15 wherein said set price is input for said outcome.

20. A method according to claim 15 wherein a current set price bet is allowed for when determining said set price for said current set price bet.

21. A method according to claim 15 wherein said set price for said outcome is determined which does not exceed the total of all the amounts bet:

a) diminished for commission;

b) diminished for the potential payout liability on previous set price bets on said outcome; and then c) divided by the total of the variable price bet amounts on said outcome.

22. A method according to claim 15 wherein a set price bet does not exceed a portion of the total of the variable price bet amounts on said outcome.

23. A method according to claim 15 wherein a bet is confirmed so that the total potential payout liability does not exceed the total of all the confirmed bet amounts diminished at least for commission.

24. A method according to claim 15 wherein a potential payout liability on a variable price bet or bets on an outcome does not exceed the total of all the amounts bet diminished for commission and for any payout liability on set price bets on said outcome.

25. A method according to claim 15 wherein a higher rate of return is provided to a person making a variable price bet on said outcome before a predetermined event or time than for a variable price bet on said outcome made after said predetermined event or time.

* * * * *